United States Patent [19]

Herrington

[11] Patent Number: 4,813,794

[45] Date of Patent: Mar. 21, 1989

[54] THERMOPLASTIC DRAW TAPE BAG WITH TACKY TAPE

[75] Inventor: Fox J. Herrington, Holcomb, N.Y.

[73] Assignee: Mobil Oil Corporation, New York, N.Y.

[21] Appl. No.: 195,921

[22] Filed: May 19, 1988

[51] Int. Cl.[4] ..... B65D 33/28

[52] U.S. Cl. ..... 383/75; 383/76

[58] Field of Search ..... 383/72, 75, 76, 92

[56] References Cited

U.S. PATENT DOCUMENTS

| | | | |
|---|---|---|---|
| 3,029,853 | 4/1962 | Piazze | 383/75 |
| 3,547,341 | 12/1970 | Kirkpatrick | 383/75 |
| 3,738,568 | 6/1973 | Ruda | 383/75 |
| 4,260,003 | 4/1981 | Hendrickson | 383/72 |
| 4,624,654 | 11/1986 | Boyd et al. | 493/194 |

FOREIGN PATENT DOCUMENTS

| | | | |
|---|---|---|---|
| 1582939 | 10/1969 | France | 383/75 |
| 1125363 | 8/1968 | United Kingdom . | |

*Primary Examiner*—Willis Little

*Attorney, Agent, or Firm*—Alexander J. McKillop; Charles J. Speciale

[57] ABSTRACT

A thermoplastic draw tape bag having a tacky coating on the draw tape at the secured end thereof and extending for a fraction of the length of the draw tape. The tacky coating comprises a material having the characteristic of sticking to itself and being adapted to cling to the inside of the hem when the uncoated length of the draw tape is withdrawn from the hem causing the hem to gather and hold the bag closed after the draw tape is pulled tight thereby preventing the bag from inadvertently coming open. The tacky coating on the draw tape may comprise a coating of glycerol mono-oleate or a layer of polyvinylidene chloride or a layer of polyisobutylene.

8 Claims, 2 Drawing Sheets

THERMOPLASTIC DRAW TAPE BAG WITH TACKY TAPE

FIELD OF THE INVENTION

The invention relates to the manufacture of flexible bags and particularly to the manufacture of draw tape bags from thermoplastic films wherein the bags are held closed without tying the draw tapes.

BACKGROUND OF THE INVENTION

Bags made of plastic film such as thin polyethylene film have been used in various sizes. Small bags are used in the packaging of sandwiches and the like; larger bags are used for shopping bags and even larger bags are used for containing trash. The present invention is particularly related to a draw tape bag having a tacky draw tape closure for preventing the bag from inadvertently coming open.

A particularly advantageous closure for such bags includes a draw band or tape constructed from the same polyethylene material. Draw tape bags of this type have been known for several years and are described in various patents such as, for example, U.S. Pat. No. 3,029,853—Piazze. Bags of this type are formed by two pliable plastic sheets joined to one another on three sides and open at a fourth. The tubular hem is provided at the open end of each sheet and contains a pliable thermoplastic strip. A hole or opening at the center of each hem exposes the strip in the hems allowing them to be pulled through the opening and used as a handle while simultaneously closing the open mouth of the bag. A similar type bag is disclosed in U.S. Pat. No. 4,624,654—Boyd et al. Draw tapes in the bags disclosed in these patents are at the same level in both hems of the bag. Draw tape bags using two tapes at different parallel levels in the bags are disclosed in U.S. Pat. No. 3,547,341—Kirkpatrick and U.S. Pat. No. 3,738,568—Ruda. In both of these patents the openings for pulling the draw tapes are at the opposite ends of the bag.

The present invention is also applicable to bags of the types disclosed in Broderick et al application Ser. No. 100,648, filed Sept. 24, 1987 entitled "Dual Draw Tape Bag and Method of Manufacture", Broderick et al application Ser. No. 100,649, filed Sept. 24, 1987 entitled "Draw Tape Bag with Two Single Tapes" and Broderick et al application Ser. No. 115,308, filed Nov. 2, 1987, entitled "Draw Tape Bag with Two Single Wrap-around Draw Tapes and Method of Manufacture", all assigned to the assignee of the present application and incorporated herein by reference thereto.

RELATED APPLICATIONS

The present invention is related to the invention disclosed in Herrington application Ser. No. 195,920 entitled "Draw Tape Bag Held Closed by Microencapsulated Adhesive", and the invention disclosed in Herrington et al application Ser. No. 195,919 entitled "Thermoplastic Draw Tape Bag with Tacky Closure Surface" all assigned to the assignee of the present application and concurrently filed herewith and incorporated herein by reference thereto.

It is an object of the present invention to provide a thermoplastic draw tape bag in which the bag is held closed by a tacky coating or surface on the tape in the area near where it is sealed to the side edges of the bag, the tacky coating comprising a material having the characteristic of sticking to itself and to cling to the inside of the hem so that the bag stays closed after the draw tape is pulled tight. There is no need to tie the tapes and the bags are more easily re-openable than with tied tapes.

SUMMARY OF THE INVENTION

In accordance with the present invention, there is provide a thermoplastic draw tape bag comprising two panels forming an open top, closed bottom bag, the panels being joined along the sides of the bag, a hem on the panels being folded over adjacent the top to receive a draw tape, the bottom of the hem being secured to the adjacent panel, a draw tape in each hem having at least one end secured at one side of the panels, each draw tape being accessible for pulling through an opening in the respective hem of the bag to withdraw the draw tape from the hem to close the open top of the bag, and a tacky coating on the draw tape at the secured end thereof and extending for a fraction of the length of the draw tape, the tacky coating comprising a material having the characteristic of sticking to itself and being adapted to cling to the inside of the hem when the uncoated length of the draw tape is withdrawn from the hem causing the hem to gather and hold the bag closed after the draw tape is pulled tight thereby preventing the bag from inadvertently coming open.

In accordance with a further aspect of the invention the inside of the hem opposite the secured end of the draw tape is provided with a tacky coating for contacting the tacky coating on the draw tape when the uncoated length of the draw tape is withdrawn from the hem thereby providing additional holding in preventing the bag from inadvertently coming open.

In accordance with a further aspect of the invention the draw tape in each hem is secured at both of its ends to the opposite sides of the panels, each draw tape being accessible for pulling through an opening in the respective hems intermediate the ends of the bag and the tacky coating on the draw tape extends from both secured ends thereof for a fraction of one-half the length of the tape.

In accordance with a further aspect of the invention the tacky coating on the draw tape is on both sides of the draw tape and the tacky coating inside the hem is on both surfaces thereof for cooperation with the tacky surfaces on the draw tape.

The tacky coating in one embodiment of the invention comprises a coating of glycerol mono-oleate. In another embodiment of the invention the tacky coating comprises a layer of polyvinylidene chloride. In another embodiment of the invention the tacky coating comprises a layer of polyisobutylene.

The foregoing and other features and advantages of the invention will be better understood from the following more detailed description and appended claims.

DESCRIPTION OF THE PREFERRED EMBODIMENTS

The plastic draw tape bags of the present invention may be made from any suitable thermoplastic material such for example as high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463—Boyd. Apparatus suitable for manufacturing draw tape bags of the present invention is disclosed in U.S. Pat. 4,625,654—Boyd et al and the disclosure therein is incorporated herein by reference thereto.

Figure 1:
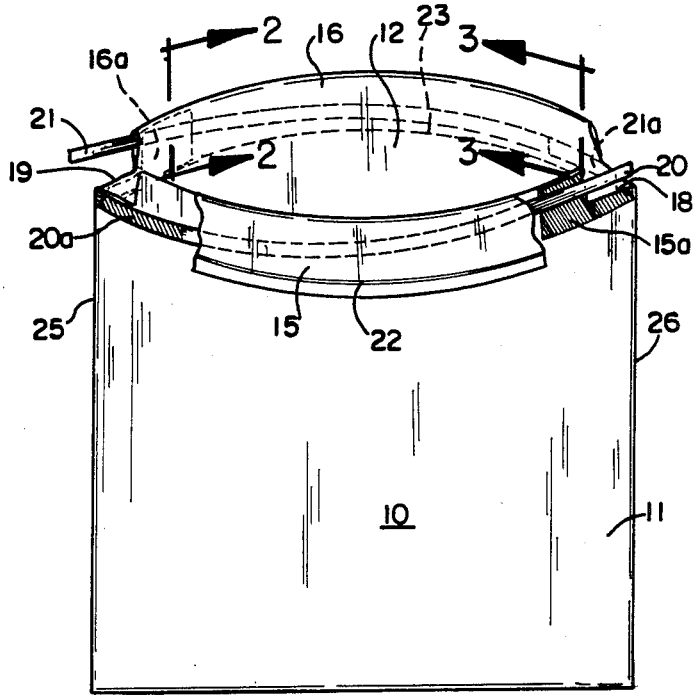
FIG. 1 is a perspective view of a draw tape bag with a tacky coated draw tape embodying the present invention.
Figure 2:
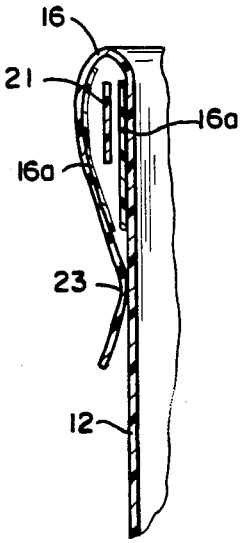
FIG. 2 is a sectional view taken along the lines 2—2 in FIG. 1.
Figure 3:
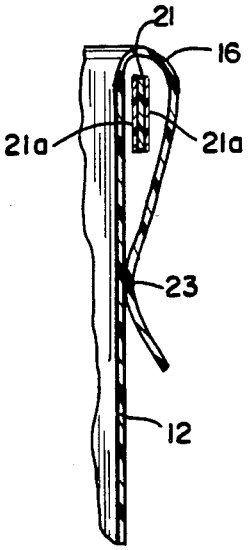
FIG. 3 is a sectional view taken along the lines 3—3 in FIG. 1.

Referring to FIGS. 1–3 it will be seen that a draw tape bag 10 according to the present invention includes a front panel 11 and a rear panel 12. The two panels preferably are formed from a tube of polyethylene which is oriented in the direction of extrusion. The bottom 13 of the bag 10 may be formed by a fold or heat seal joining the front and back panels 11 and 12. The tube is slit along the top and the two longitudinal free edges are folded over respectively against the adjoining panels 11 and 12 to provide a pair of longitudinal hems 15 and 16 of double layer thickness opposite the longitudinal fold edge of bottom 13. As shown in FIG. 1 the opposite ends of the hems 15 and 16 are provided with openings or holes 18 and 19. Each of the hems 15 and 16 is provided with a draw tape 20 and 21 respectively. After the draw tapes 20 and 21 have been inserted in the respective hems 15 and 16, the double layer thickness of each hem is longitudinally joined together along seal lines 22 and 23 to form opposed tubular channels each containing one of the draw tapes 20 and 21.

As may be seen in FIG. 1 one end of the draw tape 20 is secured at one side of the panels when the side bag seal 25 is made. The opposite end of the draw tape 20 is accessible for pulling through the opening 18 in the respective hem 15 of the bag to withdraw the draw tape 20 from the hem to close the open top of the bag. Similarly, the draw tape 21 in hem 16 is secured at one end to the opposite side of the bag when the side seal 26 is made. The other end of the draw tape 21 is accessible for pulling through the opening 19 in the hem 16 of the bag to withdraw the draw tape 21 from the hem to close the open top of the bag.

As may be seen in FIG. 1 the draw tape 20 is coated with a tacky material **20*a* for only a fraction of its length, preferably about 15%, and the area 20*a* is adjacent to where the end the tape 20 is sealed to the edge of the bag at 25. Similarly, the tape 21 is coated with a tacky material 21*a* for only a fraction of its length, preferably about 15%, and that tacky coating 21*a* is on the area adjacent to where the tape 21 is sealed to the edge of the bag at the side seal 26. The tacky coatings 20*a* and 21*a* on the respective draw tapes comprise a material having the characteristic of sticking to itself and being adapted to cling to the inside of the respective hems when the uncoated length of the respective draw tapes is withdrawn from the respective hems causing the hems to gather and hold the bag closed after the draw tapes are pulled tight thereby preventing the bag from inadvertently coming opened. Both sides of the draw tapes may be provided with the tacky coating as illustrated in FIG. 3 in connection with draw tape 21 where it will be seen that the tacky coating 21*a* is applied to both sides of the draw tape 21. For additional holding, the inside of the hem can also be provided with a tacky coating, but this would be at the end opposite to where the tape is attached to the edge of the bag. When the tape is withdrawn, this is the last part of the hem into which the tacky part of the tape comes in contact when it is nearly fully withdrawn. This is illustrated in FIG. 1 where it will be seen that the inside of the hem 15 is provided with a tacky coating 15*a* adjacent the right hand edge 26 of the bag. When the draw tape 20 is withdrawn from the hem 15 the tacky coating 20*a* of the draw tape does not come in contact with the tacky coating 15*a* of the hem until the draw tape 20 is nearly fully withdrawn from the hem 15. It will also be noted that the hem 16 is provided on the inside thereof with a tacky coating 16*a* at the left hand edge of the bag adjacent the side seal 25. When the tape 21 is withdrawn, the tacky surface 16*a* of the hem is the last part of the hem into which the tacky surface 21*a* of the tape comes in contact when the tape 21 is nearly fully withdrawn. As shown in FIG. 2, the tacky surface on the inside of the hems may be provided on both inner surfaces of the hems as illustrated by the tacky surfaces 16*a*, 16*a*. These surfaces would cooperate with and engage the tacky surfaces 21*a*, 21*a* on the draw tape 21 when the uncoated length of the draw tape 21 is withdrawn from the hem 16 causing the hem 16 to gather and hold the bag closed after the draw tape 21** is pulled tight thereby preventing the bag from inadvertently coming open.

As pointed out above the tacky coating material has the characteristic of sticking to itself and being adapted to cling to the inside of the hem when the uncoated length of the draw tape is withdrawn from the hem. The tacky coating may comprise a material such as glycerol mono-oleate. As an alternative the tacky coating may comprise a layer of polyvinylidene chloride sold under the trademark Saran Wrap or the tacky coating may comprise a layer of a sticky polymer such as a layer of polyisobutylene. It is to be understood that the tacky coating materials **20*a*, 21*a* and 15*a*, 16*a*** may comprise other equivalent materials so long as they have the characteristic of sticking to itself and being adapted to hold the bag closed after the draw tape is pulled tight. Thus the need to tie the tapes is eliminated and the bags are more easily re-openable than with tied tapes.

While the draw tape bag 10 illustrated in FIGS. 1–3 is of the type having an opening at the ends of the hems it is to be understood that the present invention is also applicable to draw tape bags of other types where the opening in the hem is intermediate the ends of the hem. Such a draw tape bag is illustrated in FIGS. 4–6.

Figure 4:
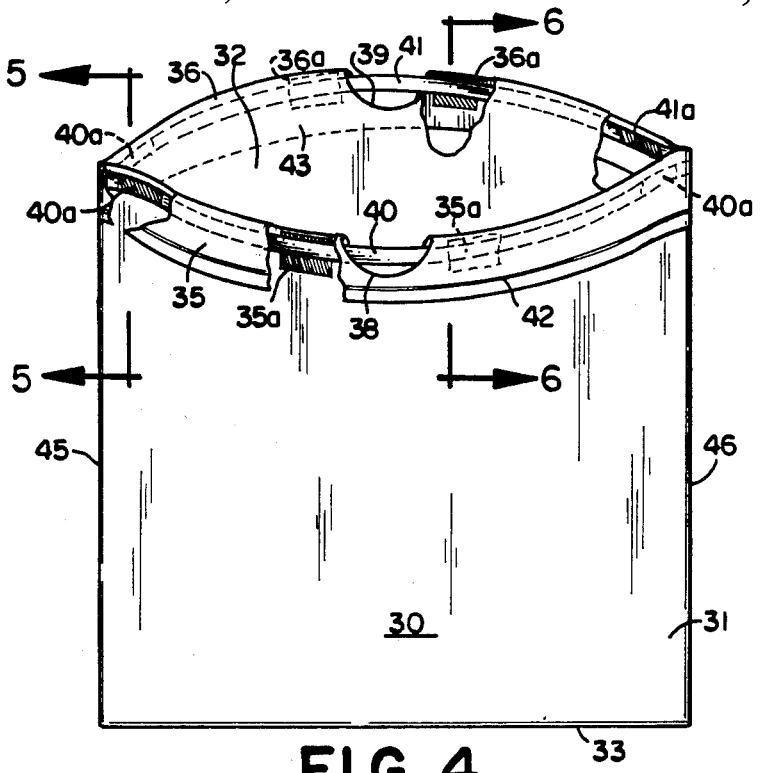
FIG. 4 is a perspective view of a draw tape bag having the opposite ends of the draw tape secured to the opposite sides of the bag and the opposite ends of the draw tape provided with a tacky coating embodying the present invention.
Figure 5:
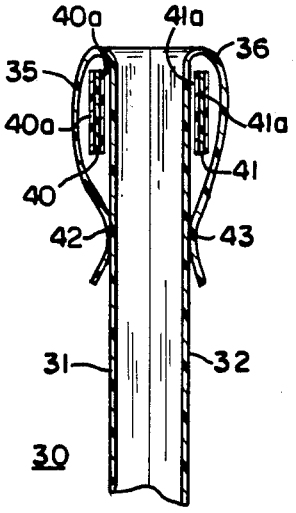
FIG. 5 is a sectional view taken along the lines 5—5 in FIG. 4.
Figure 6:
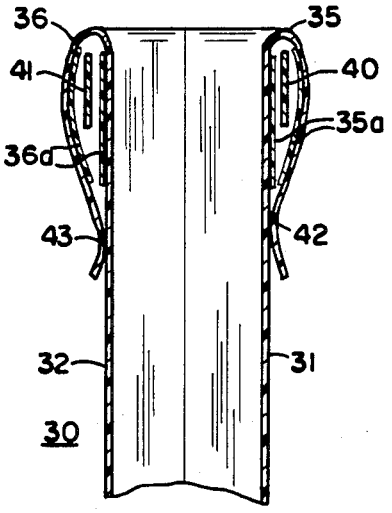
FIG. 6 is a sectional view taken along the lines 6—6 in FIG. 4.

Referring to FIGS. 4–6 it will be seen that a draw tape bag 30 according to the present invention includes a front panel 31 and a rear panel 32. The two panels are preferably formed from a tube of polyethylene which is oriented in the direction of extrusion. The bottom 33 of the bag 30 may be formed by a fold or heat seal joining the front and back panels 31 and 32. The tube is slit along the top and the two longitudinal free edges are folded over respectively against the adjoining panels 31 and 32 to provide an open mouth comprising a pair of longitudinal hems 35 and 36 of double layer thickness opposite the longitudinal fold edge of bottom 33. As shown in FIG. 4 the hems 35 and 36 are provided with openings or holes 38 and 39 for access to the draw tapes 40 and 41 inserted in the respective hems. After the draw tapes 40 and 41 have been inserted in the respective hems 35 and 36 the double layer thickness of each hem is longitudinally joined together along seal lines 42 and 43 to form opposed tubular channels each containing one of the draw tapes 40 and 41 respectively. The ends of the draw tapes 40 and 41 are secured to the respective sides of the bag 30 when the side heat seals 45 and 46 are made.

As may be seen in FIG. 4 the draw tape 40 is coated at its ends with a tacky material 40*a* for only a fraction of its length, preferably about 10%, and the areas 40*a*, 40*a* are adjacent to where the ends of the tape 40 are sealed to the edges of the bag at 45 and 46. Similarly, the tape 41 is coated at its ends with a tacky material 41*a* for only a fraction of its length, preferably abut 10%, and the tacky coating areas 41*a*, 41*a* are adjacent to where the ends of the tape 46 are sealed to the edges of the bag at the side seals 45 and 46. The tacky coatings 40*a* and 41*a* on the respective draw tapes 40 and 41 comprise a material having the characteristic of sticking to itself and being adapted to cling to the inside of the respective hems 35 and 36 when the uncoated length of the respective draw tapes is withdrawn from the respective hems through the openings 38 and 39 causing the hems to gather and hold the bag closed after the draw tapes 40, 41 are pulled tight thereby preventing the bag from inadvertently coming opened. Both sides of the draw tapes may be provided with the tacky coating as illustrated in FIG. 5 in connection with draw tape 41 where it will be seen that the tacky coating 41*a* is applied to both sides of the draw tape 41 nd the tacky coating 40*a* is applied to both sides of the draw tape 40.

For additional holding, the inside of the hem can also be provided with a tacky coating, but this would be adjacent the openings 38 and 39 and not where the tapes are attached to the edges of the bag. When the tapes are withdrawn, this is the last part of the hem into which the tacky part of the tape comes in contact when it is nearly fully withdrawn. This is illustrated in FIGS. 4–6 where it will be seen that the inside of the hem 35 is provided with tacky coatings 35*a*, 35*a* adjacent both sides of the opening 38 in hem 35. When the draw tape 40 is withdrawn from the hem 35 through opening 38, coatings 40*a*, 40*a* of the draw tape 40 do not come in contact with the corresponding tacky coatings 35*a*, 35*a* of the hem until the draw tape 40 is nearly fully withdrawn from the hem 35. It will also be noted that the hem 36 is provided on the inside thereof with tacky coatings 36*a*, 36*a* adjacent both sides of the opening 39. When the tape 41 is withdrawn, the tacky surfaces 36*a*, 36*a* of the hem are the last parts of the hem into which the tacky surfaces 41*a*, 41*a* of the tape come in contact with the tape 41 is nearly fully withdrawn. As shown in FIG. 6 the tacky surface on the inside of the hems may be provided on both inner surfaces of the hems 35 and 36 as illustrated by the tacky surfaces 35*a*, 35*a* and 36*a*, 36*a*. These surfaces would cooperate with and engage the corresponding tacky surfaces 40*a*, 40*a* and 41*a*, 41*a* on the draw tapes 40 and 41 when the uncoated lengths of the draw tapes are withdrawn from the hems 35 and 36 causing the hems to gather and hold the bag closed after the draw tapes are pulled tight thereby preventing the bag from inadvertently coming open.

As pointed out above the tacky coating material has the characteristic of sticking to itself and being adapted to cling to the inside of the hem when the uncoated length of the draw tape is withdrawn from the hem. The tacky coatings 40*a*, 41*a* and 35*a*, 36*a* may comprise the same materials as coatings 20*a*, 21*a* and 15*a* and 16*a* in FIGS. 1–3. It is to be understood that the tacky coating materials may comprise other equivalent materials so long as they have the characteristic of sticking to itself and being adapted to hold the bag closed after the draw tape is pulled tight. Thus the need to tie the tapes is eliminated and the bags are more easily re-openable than with tied tapes.

What is claimed is:

1. A thermoplastic draw tape bag comprising:

two panels forming an open top, closed bottom bag, said panels being joined along the sides of said bag;

a hem on said panels being folded over adjacnt said top to receive a draw tape, the bottom of said hem being secured to the adjacent panel;

a draw tape in each hem having at least one end secured at one side of said panels, each said draw tape being accessible for pulling through an opening in the respective hem of said bag to withdraw said draw tape from said hem to close said open top of said bag; and a tacky coating on said draw tape at the secured end thereof and extending for a fraction of the length of said draw tape, said tacky coating comprising a material having the characteristic of sticking to itself and being adapted to cling to the inside of the hem when the uncoated length of the draw tape is withdrawn from the hem causing the hem to gather and hold the bag closed after the draw tape is pulled tight thereby preventing the bag from inadvertently coming open.

2. A draw tape bag according to claim 1 wherein said tacky coating is on both sides of said draw tape.

3. A draw tape bag according to claim 1 wherein said draw tape in each hem is secured at both of its ends to the opposite sides of said panels, each said draw tape being accessible for pulling through an opening in the respective hem intermediate the ends of said bag and said tacky coating on said draw tape extends from both secured ends thereof for a fraction of one-half the length of said tape.

4. A draw tape bag according to claim 1 wherein said tacky coating on said draw tape extends for approximately 15% of the length of the said draw tape.

5. A draw tape bag according to claim 1 wherein said tacky coating on said draw tape comprises a coating of glycerol mono-oleate.

6. A draw tape bag according to claim 1 wherein said tacky coating on said draw tape comprises a layer of polyvinylidene chloride.

7. A draw tape bag according to claim 1 wherein said tacky coating on said draw tape comprises a layer of polyisobutylene.

8. A draw tape bag according to claim 1 wherein the inside of the hem opposite the secured end of the draw tape is provided with a tacky coating for contacting the tacky coating on said draw tape when said uncoated length of the draw tape is withdrawn from the hem thereby providing additional holding in preventing the bag from inadvertently coming open.

* * * * *